US006364309B1

(12) United States Patent
Tomatsu

(10) Patent No.: US 6,364,309 B1
(45) Date of Patent: Apr. 2, 2002

(54) SHEET ACCOMMODATING DEVICE

(75) Inventor: Yoshiya Tomatsu, Kasugai (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 09/644,296

(22) Filed: Aug. 23, 2000

(30) Foreign Application Priority Data

Aug. 30, 1999 (JP) ..... 11-243218
Aug. 30, 1999 (JP) ..... 11-243219
Aug. 30, 1999 (JP) ..... 11-243220

(51) Int. Cl.[7] ..... B65H 1/10; B65H 1/12; B65H 1/00; B65H 31/14

(52) U.S. Cl. ..... 271/160; 271/171; 271/144; 271/219; 271/223

(58) Field of Search ..... 271/160, 171, 271/144, 219, 223

(56) References Cited

U.S. PATENT DOCUMENTS 1,951,067 A * 3/1934 Shepherd ..... 101/133
3,533,617 A * 10/1970 Collins ..... 271/39
4,033,577 A * 7/1977 Godard et al. ..... 271/128

* cited by examiner

*Primary Examiner*—David H. Bollinger
*Assistant Examiner*—Kenneth W Bower
(74) *Attorney, Agent, or Firm*—Oliff & Berridge, PLC

(57) ABSTRACT

A sheet accommodating device is provided which always performs stable sheet feeding in accordance with sizes of sheets or the number of sheets to be stacked. A holder member that is movable back and forth supports a sheet pressing plate near the center of gravity of the sheets. The holder member is movable in accordance with the sizes of the sheets or the amount of stacked sheets, so that the sheets can be stacked and fed with stability.

20 Claims, 9 Drawing Sheets

SHEET ACCOMMODATING DEVICE

BACKGROUND OF THE INVENTION

1. Field of Invention

The invention relates to a sheet accommodating device for accommodating a stack of sheets in an image forming apparatus.

2. Description of Related Art

Japanese Utility Model Publication JP-U-62-181530 discloses a sheet cassette that is to be mounted in a printer. A structure of this sheet cassette is shown in FIG. 10. The sheet cassette 101 includes a sheet pressing plate 102 where a stack of sheets are placed thereof, a spring 104 for urging a front end of the sheet pressing plate 102 against a sheet feed roller 103, and a support member 105 for supporting the sheet pressing plate 102 at the center of gravity of the sheets to be stacked so that the sheet pressing plate 102 is swingable vertically. As the front end of the sheet pressing plate 102 is swung upward on the support member 105, a rear end of the sheet pressing plate 102 is swung downward, like a seesaw. The sheet pressing plate 102 is provided with an end guide 106 for supporting rear edges of the sheets to be stacked by moving back and forth.

However, in the seesaw type sheet cassette shown in FIG. 10, the center of gravity of the sheet deviates from the position where the support member 105 supports the sheet pressing plate 102 because the centers of gravity of the sheets vary with the size of the sheets to be stacked. As a result, the sheet pressing plate 102 is not swung with stability.

Further, there is a large difference (Dh) between a height from a bottom of the sheet cassette to the rear end of the sheet pressing plate 102 when few sheets are stacked (h1) and the height when a large number of sheets are stacked (h2). Therefore, there is a problem that the printer becomes large in size.

In particular, in order for the sheet cassette to accommodate a large amount of sheets, the difference Dh becomes larger, so that the printer becomes larger in size. Consequently, it is difficult to make the sheet cassette small in size.

The seesaw type sheet cassette can minimize variations of a pressing force from the spring 104 traceable to a weight change that occurs due to variations in size of the sheets. However, the amount of compression of the spring 104 varies in accordance with the amount of stacked sheets, so that the pressing force from the spring 104 varies and sheet feeding operation becomes unstable.

SUMMARY OF THE INVENTION

According to the invention, a sheet accommodating device is provided which can always perform sheet feeding with stability in accordance with the size of sheets or the amount of sheets to be stacked.

In the invention, the sheet accommodating device includes a stacking portion holding a sheet thereon, a first urging member urging one end of the stacking portion upward, and a support member that is movable back and forth relative to the stacking portion and supports the stacking portion near a center of gravity of the sheet to be stacked on the stacking portion.

According to this structure, the support member moves back and forth relative to the stacking portion so as to support the stacking portion near the center of gravity of the sheet to be stacked. Therefore, the support member can be moved back and forth even when the size of the sheets to be stacked on the stacking portion is changed, and thus the support member can support the stacking portion near the center of gravity of the sheet at all times and the stacking portion is swung with stability.

The sheet accommodating device further includes a rear edge support member that supports a rear edge of the sheet and is disposed at a rear end of the stacking portion so as to be movable in accordance with the size of the sheet, and a link mechanism that moves the support member back and forth in accordance with a movement of the rear edge support member.

According to this structure, when the rear edge support member is moved back and forth in accordance with the size of the sheet to be stacked, the link mechanism moves the support member back and forth relative to the stacking member so that the support member supports the stacking member near the center of gravity of the sheets, in synchronization with the movement of the rear edge support member. Therefore, the stacking portion can be supported by the support member at a position near the center of gravity at all times by a simple operation such as moving the rear edge support member in accordance with the sheet size.

The link mechanism acts so that the amount of travel of the support member becomes half distance of the rear edge support member. The link mechanism includes a pinion gear and a rack and the amount of travel is determined by arranging the number of teeth of the pinion gear and the rack. With such a link mechanism, the support member can support the stacking portion at the center of gravity of the sheet.

Further, a second urging member that urges the stacking portion upward may be provided near the support member. When a large number sheets are stacked on the stacking portion, the weight of the stock of the sheets overcomes the urging force from the spring and thus the sheet pressing plate 53 is moved downward. In accordance with the downward movement, the other end of the stacking portion is also moved downward.

On the other hand, when few sheets are stacked, the urging force from the spring overcomes the weight of the stack of sheets and thus the sheet pressing plate is moved upward. In accordance with the upward movement, the other end of the stacking portion is moved also upward.

Therefore, variations in the position of the other end of the stacking portion between a case when a large number sheets are stacked and a case when few sheets are stacked become small. Accordingly, the sheet accommodating device does not need to be large in size and thus it can be compact in size even when the amount of the sheets that can be accommodated in the sheet accommodating device is increased.

A spring constant of the second urging member may be equal to a weight per unit thickness of the stack of sheets on the stacking portion. That is, the second urging member acts to move the stacking portion downward by an amount corresponding to a thickness of the sheets added. As the stacked sheets are removed, the second urging member acts to move the stacking portion upward by the amount corresponding to the thickness of the sheets removed.

Therefore, even when the stacked sheets are added or removed, the stacking portion is vertically moved by an amount corresponding to the thickness of the sheets that have been added or removed. Consequently, the sheets on the stacking portion can be held at a certain position at all times, so that there is little variation in the vertical movement and the sheets can be fed with stability.

Further, the support member can support the stacking portion so that a pressing force acting on one end of the stacking portion by the first urging member becomes constant regardless of the number of the sheets stacked on the stacking portion.

Therefore, even when the thickness or weight of the sheets to be stacked on the stacking portion is changed, the pressing force acting on the one end of the stacking portion becomes nearly constant regardless of the weight of the sheets to be stacked on the stacking portion. That is, the stacking portion always presses the sheets upward with a nearly constant pressing force by the urging force from the first urging member, so that the sheets can be fed with stability.

In particular, the support member supports the stacking portion at a position expressed by X that satisfies an equation below.

$$Y-2XZ=(F=\text{nearly constant})$$

wherein:

Y is the urging force from the first urging member;

X is the offset from the center of gravity in a back and forth direction of the sheet;

Z is the weight per unit length of the stack of sheets;

F is the pressing force acting on one end of the stacking portion.

Even when the urging force Y from the first urging member is changed in accordance with change of the weight per unit length Z of the sheet caused by changing the number of sheets, the stacking portion is supported by the support member at a position where the pressing force F acting on the one end of the stacking portion becomes nearly constant at all times. Therefore, the sheet stacking portion presses the sheet upward with a constant pressing force by the urging force from the first urging member, so that the sheets can be fed with stability.

In other words, in accordance with the weight change of the sheets to be stacked on the stacking portion, the pressing force acting on the one end of the stacking portion is maintained at nearly constant value by changing a position where the support member supports the sheet staking member as necessary, so that the sheets can be fed with stability regardless of the number of the sheets.

Further, when the variation of the pressing force acting on the one end of the stacking portion is determined ±10%, the sheets can be fed more stably.

Furthermore, when the pressing force acting on the one end of the stacking portion is between 100–600 gf, the pressing force acts on the one end of the stacking portion at all times, so that the sheets can be fed with stability.

BRIEF DESCRIPTION OF THE DRAWINGS

Various exemplary embodiments of the invention will be described in detail with reference to the following figures wherein.

DETAILED DESCRIPTION OF PREFERRED EMBODIMENTS

Figure 1:
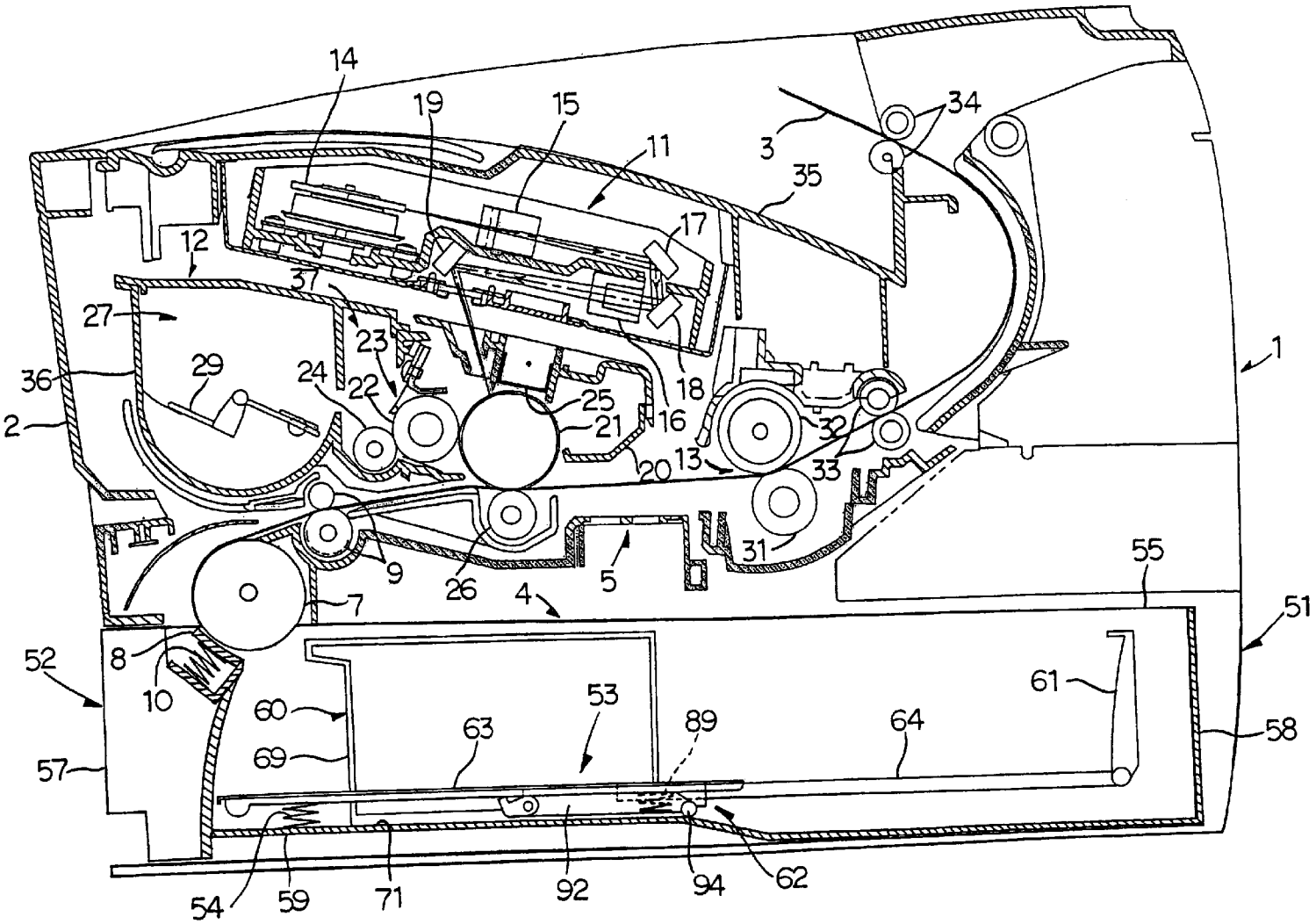
FIG. 1 a side sectional view of a laser beam printer.

FIG. 1 is a side sectional view showing an embodiment of a laser beam printer provided with a sheet accommodating device according to the invention.

In FIG. 1, a laser beam printer 1 includes a feeder unit 4, an image forming unit 5 for forming a predetermined image on a sheet 3 fed from the feeder unit 4, and the like, in a main casing 2.

The feeder unit 4 includes a sheet cassette accommodating portion 51 formed at a bottom of the main casing 2, a sheet cassette 52 detachably attached to the sheet cassette accommodating portion 51, a sheet feed roller 7 disposed above one end of the sheet cassette 52, and resist rollers 9 disposed downstream of a feed direction of the sheet 3 with respect to the sheet feed roller 7.

As described later, the sheet cassette 52 includes a sheet pressing plate 53 where the sheets 3 are to be stacked, springs 54, a separation pad 8, and a spring 10 that urges the separation pad 8. The springs 54 upwardly urge a front end portion of the sheet pressing plate 53, more particularly, the end portion of the sheet pressing plate 53 near the sheet feed roller 7, from the reverse side of the sheet pressing plate 53. The separation pad 8 and the spring 10 are illustrated in only FIG. 1, in other words, they are omitted in FIGS. 2 trough 9.

An uppermost sheet 3 in the stack on the sheet pressing plate 53 is pressed against the sheet feed roller 7 by the urging force from the springs 54, from the reverse side of the sheet pressing plate 53. As the sheet feed roller 7 rotates, the sheet 3 is pinched between the sheet feed roller 7 and the separation pad 8. The sheets 3 are fed in one sheet at a time. The resist rollers 9 include a drive roller and a driven roller. The resist rollers 9 temporarily stop the sheet 3 fed from the sheet feed roller 7 to adjust a deviation of the sheet 3 and then feed the sheet 3 to the image forming unit 5.

The image forming unit 5 includes a scanning unit 11, a developing unit 12, and a fixing unit 13.

The scanning unit 11 is provided in an upper portion of an internal space of the main casing 2. The scanning unit 11 has a laser emitting portion (not shown), a rotatable polygon mirror 14, lenses 15, 16, and reflecting mirrors 17, 18, 19. A laser beam that is emitted from the laser emitting portion based on predetermined image data sequentially passes through or is reflected by the polygon mirror 14, the lens 15, the reflecting mirrors 17, 18, the lens 16, and the reflecting mirror 19 in that order as indicated by a dot and dashed line. The laser beam is thus directed to and high-speed scanned over a photosensitive drum 21 of the developing unit 12 for irradiation of the surface of the photosensitive drum 21.

The developing unit 12 is disposed below the scanning unit 11. The developing unit 12 includes the photosensitive drum 21, a developing cartridge 36, a scorotron electrical charging device 25, and a transfer roller 26 in a drum cartridge 20 that is detachably attached to the main casing 2.

An internal space of the developing cartridge 36 is divided into a developing chamber 37 that contains the developing roller 22, a layer thickness-regulating blade 23, and a supply roller 24, and into a toner box 27 containing toner. The toner box 27 contains positively electrically charged toner of a single non-magnetic component. The toner is agitated by an agitator 29 provided at a center of the toner box 27, and is discharged into the developing chamber 37. In the developing chamber 37, the supply roller 24 is rotatably disposed at the toner box 27 side. The developing roller 22 is rotatably disposed facing the supply roller 24. The supply roller 24 and the developing roller 22 are disposed in contact with each other so that they are press-deformed against each other to an appropriate extent. The supply roller 24 is formed by covering a metallic roller shaft with a roller part formed from an electrically conductive foam material. The developing roller 22 is formed from by covering a metallic roller shaft with a roller part formed by an electrically conductive rubber material. The developing roller 22 is applied a bias so as to produce an electric potential difference between the developing roller 22 and the photosensitive drum 21. The layer thickness-regulating blade 23 that regulates a thickness of toner on the developing roller 22 is disposed near the developing roller 22.

Toner discharged from the toner box 27 into the developing chamber 37 is supplied to the developing roller 22 as the supply roller 24 rotates. At this time, toner is positively electrically charged between the supply roller 24 and the developing roller 22 due to friction. After being supplied onto the developing roller 22, toner enters a gap between the layer thickness-regulating blade 23 and the developing roller 22 as the developing roller 22 rotates. Toner becomes sufficiently electrically charged therebetween due to friction, and is formed into a thin layer of a predetermined thickness on the developing roller 22.

The photosensitive drum 21 is rotatably disposed beside the developing roller 22 so that the photosensitive drum 21 faces the developing roller 22. A drum body of the photosensitive drum 21 is grounded, and its surface is formed from a positively electrically charged organic photosensitive material containing a polycarbonate as a main component. The scorotron electrical charging device 25 is disposed at a predetermined interval upward from the photosensitive drum 21. The scorotron electrical charging device 25 produces corona discharge from a tungsten wire and positively charges the surface of the photosensitive drum 21 uniformly.

After the surface of the photosensitive drum 21 is uniformly positively charged by the scorotron electrical charging device 25, the surface of the photosensitive drum 21 is exposed to a laser beam emitted from the scanning unit 11 so that an electrostatic latent image is formed based on predetermined image data. The electrostatic latent image is portions of the uniformly positively charged surface of the photosensitive drum 21 that have a reduced electric potential due to exposure to the laser beam. When positively charged toner carried on the developing roller 22 come to face and contact the photosensitive drum 21 as the developing roller 22 rotates, the toner is selectively transferred and deposited onto the electrostatic latent image formed on the surface of the photosensitive drum 21, so that the image is visualized. Thus, image development (reversal development) is accomplished.

The transfer roller 26 is rotatably disposed below the photosensitive drum 21, facing the photosensitive drum 21. The transfer roller 26 is formed by covering a metallic roller shaft with a roller part formed from an electrically conductive rubber material. A predetermined transfer bias is applied to the transfer roller 26. Therefore, the toner image developed on the photosensitive drum 21 is transferred to the sheet 3 due to the transfer bias when the sheet 3 is passed between the photosensitive drum 21 and the transfer roller 26.

The fixing unit 13 is disposed beside the developing unit 12, that is downstream thereof, as shown in FIG. 1. The fixing unit 13 includes a heat roller 32, a pressing roller 31 pressed against the heat roller 32, and a pair of conveying rollers 33 disposed downstream of the heat roller 32 and the pressing roller 31. The heat roller 32 is a hollow-roller made from metal and is equipped with a heating halogen lamp. While the sheet 3 is being passed between the heat roller 32 and the pressing roller 31, toner transferred on the sheet 3 melts and becomes fixed due to heat. Then, the sheet 3 is conveyed to a pair of sheet ejecting rollers 34 by the conveying rollers 33. The sheet 3 is then ejected on an output tray 35 by the sheet ejecting rollers 33.

A structure of the sheet cassette 52 will be described below.

Figure 2:
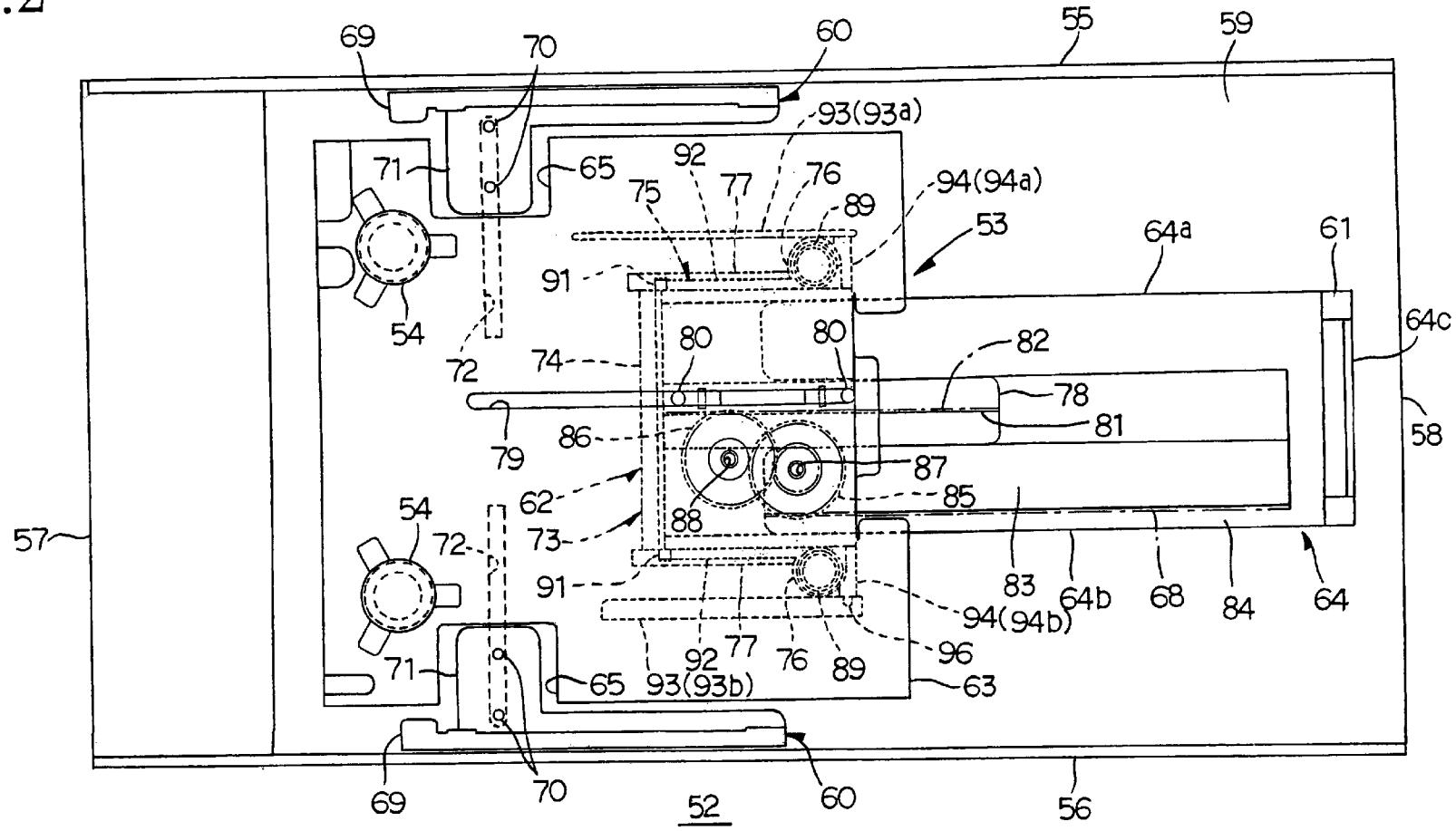
FIG. 2 is a plan view of a sheet cassette provided in the laser beam printer of FIG. 1.

As shown in FIGS. 1 and 2, the sheet cassette 52 is formed in a generally rectangular box shape having an upper open structure. The sheet cassette 52 is formed by side plates 55, 56 disposed on both sides of the sheet cassette 52 in a width direction so as to face each other, a grip portion 57 provided at the front end in a feed direction of the sheet 3, a rear plate 58 provided at the rear end, and a bottom plate 59.

In the sheet cassette 52, there are the sheet pressing plate 53, the springs 54, side guides 60, an end guide 61, and a holder member 62.

The sheet pressing plate 53 includes a front plate 63 that receives the front portion of the sheet 3 and a rear plate 64 that receives the rear portion of the sheet 3.

The front plate 63 is formed in a generally rectangular shape. Side openings 65 are defined at each side portion of the front plate 63 by concavely and inwardly carving out in the width direction of the sheet cassette 52 from each side edge of the front plate 63. A holder member guide groove 79 that slidably receives slide guides 80 (described later) is formed in a middle portion of the front plate 63 in the width direction so as to extend in a back and forth direction.

Figure 4:
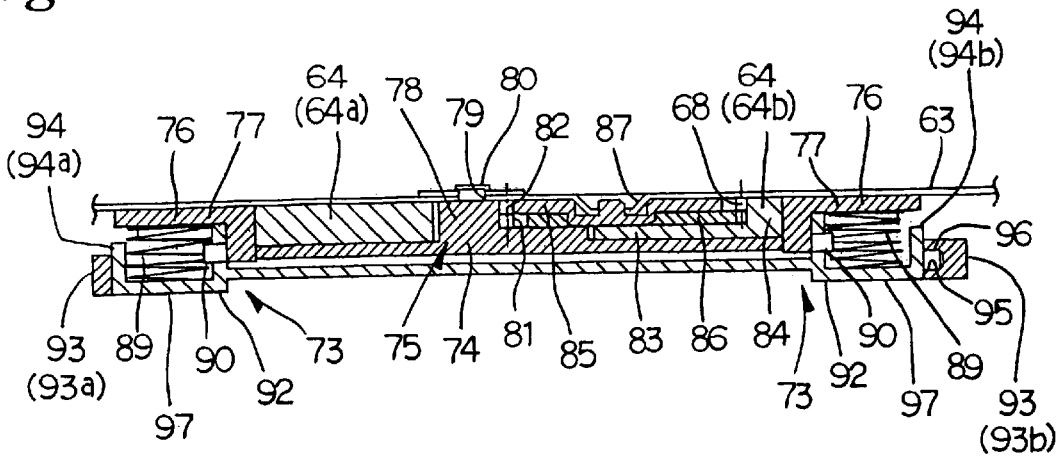
FIG. 4 is a partially enlarged cross sectional view of the sheet cassette of FIG. 3.

The rear plate 64 having a generally U-shaped rectangular shape is narrower than the front plate 63 and extends in the back and forth direction. The rear plate 64 has a pair of side portions 64*a* and 64*b* that extend in the back and forth direction in parallel each other with a rear plate guide member 78 sandwiched therebetween and a rear portion 64*c* by which the side portions 64*a* and 64*b* are connected to each other. As shown in FIG. 4, the side portion 64*a* is formed in a rectangular shape in cross section, and the side portion 64*b* is formed in a generally L-shape in cross section. The side portion 64*b* is formed by a bottom wall 83 and a side wall 84 that stands from outside in the width direction of the bottom wall 83. A rack 68 that engages a first pinion gear 85 (described later) is formed on the internal surface of the side wall 84 across the back and forth direction.

The rear plate 64 overlaps the front plate 63 at a middle portion in the width direction of the front plate 63 so that the bottom surface of the front plate 63 can slide on the upper surface of the rear plate 64. The rear plate 64 is disposed so as to extend toward the rear from the position where the front plate 63 and the rear plate 64 overlap each other.

The springs 54 are mounted on two positions (right and left) in the width direction of the front end of the bottom plate 59 and are opposed to the reverse side of the front end of the front plate 63. The front end of the front plate 63 is urged against the sheet feed roller 7 by the two springs 54.

Each side guide 60 is provided at a position facing each side opening 65 of the front plate 65. Each side guide 60 has a generally rectangular shaped side edge contact member 69 for contacting both sides of the sheets 3 in the width direction and a side edge slide member 71 for supporting the side edge contact member 69. The side edge slide member 71 is provided with protrusions 70 on its reverse side. Side guide guiding grooves 72 that guide the side guides 60 along the width direction are formed in the width direction of the sheet cassette 52 at positions opposed to the side edge slide members 71 of each side guide 60.

Each side guide 60 can be slid either outward or inward in the width direction along each side guide guiding groove 72 by engaging the protrusions 70 of each side edge slide member 71 with each side guide guiding groove 72. When large sized sheets 3, e.g. A3- or B3-size sheets, are stacked in the sheet cassette 52, the side guides 60 are slid outward in the width direction so as to regulate the side edges of the sheets 3. On the other hand, when small sized sheets 3, e.g., A4- or B5-size sheets, are stacked in the sheet cassette 52, the side guides 60 are slid inward in the width direction so as to regulate the side edges of the sheets 3.

The end guide 61 stands from the rear end of the rear plate 64. The end guide 61 has a generally rectangular shape and moves back and forth together with the rear plate 64 to support the rear edge of the sheet 3, in accordance with size of the stack of sheets 3.

The holder member 62 is disposed near the center of gravity of the sheet 3 in the halfway of the length of the sheet pressing plate 53. The holder member 62 can slide back and forth relative to the front plate 63 and supports the sheet pressing plate 53 so that the sheet pressing plate 53 can be swung vertically. The holder member 62 includes a holder frame 73 attached to the reverse surface of the front plate 63 and a holder arm 75 swingably attached to the holder frame 73.

Figure 3:
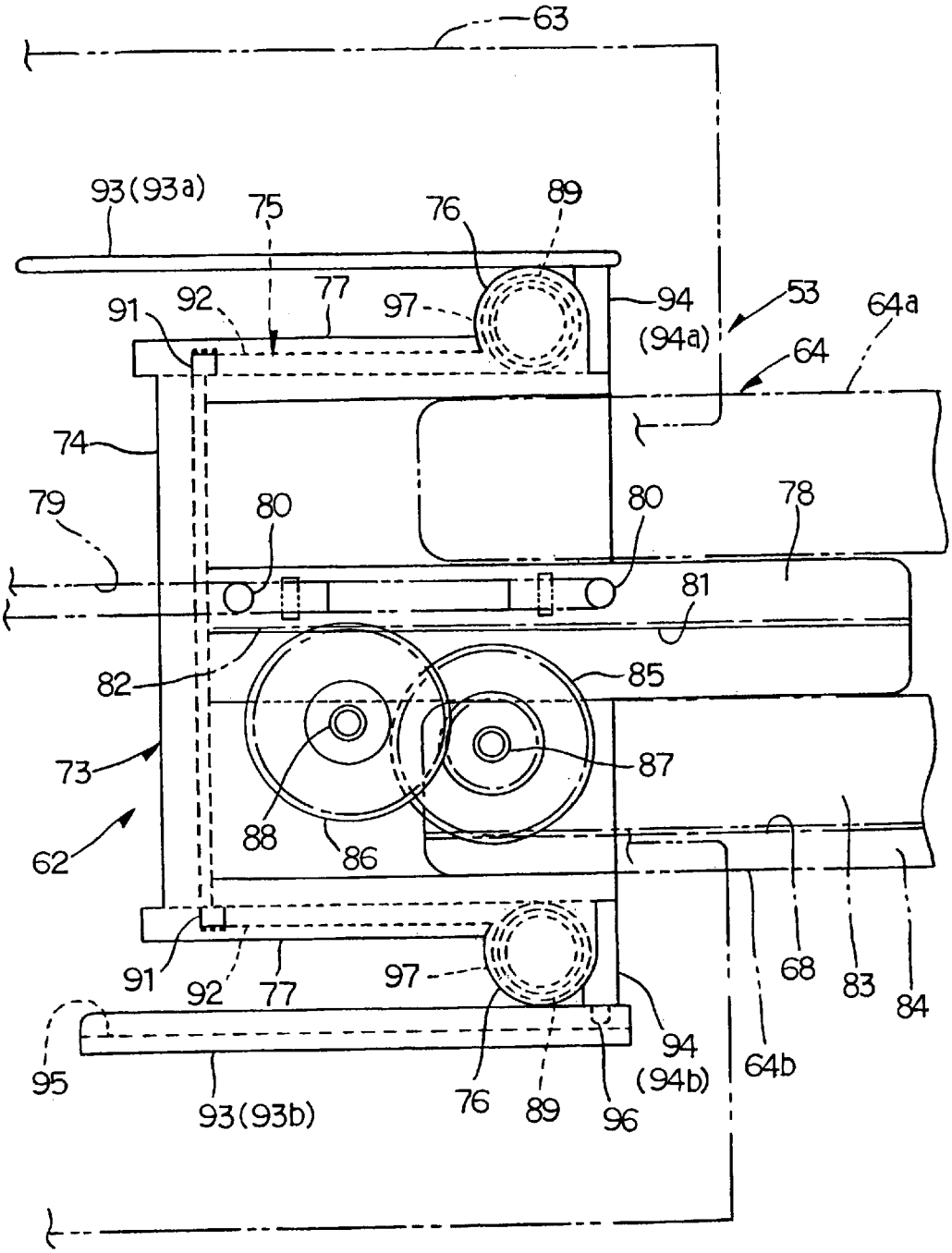
FIG. 3 is a partially enlarged plan view of the sheet cassette of FIG. 2.

As shown in FIGS. 3 and 4, the holder frame 73 is made up of a housing portion 74 that is concavely formed toward the bottom surface of the front plate 63 and collar portions 77 that are formed outwardly in the width direction of the housing portion 74. A rectangular rear plate guide member 78 extending in the back and forth direction protrudes from the middle portion in the width direction of the housing portion 74. The inside of the housing portion 74 is partitioned off to make two rectangular rooms by the rear plate guide member 78.

Slide guides 80 that are engaged with the holder member guide groove 79 protrudes from the upper surface of the rear plate guide member 78. Each collar portion 77 is slidably in contact with the bottom surface of the front plate 63. With this structure, the holder frame 73 supports the front plate 63 in a state where the holder frame 73 can be slid back and forth relative to the front plate 63 while guided along the holder member guide groove 79. Each collar portion 77 has a circular spring pressing portion 76 to make contact with a spring 89 (described later).

The rear plate guide member 78 extends toward the rear from the housing portion 74 to make a rectangular shape and a stepped portion 81 is formed on the rear plate guide member 78 in its back and forth direction. A rack 82 that engages a second pinion gear 86 (described later) is formed on the surface of the side wall of the stepped portion 81 along the stepped portion 81.

Within the housing portion 74, the side portion 64*a*, having a rectangular shape in cross section, of the rear plate 64 is inserted in one room partitioned by the rear plate guide member 78 and the side portion 64*b* having a generally rectangular shape in cross section is inserted in another room. Therefore, the rear plate 64 is supported by the holder member 62 in a state where the rear plate 64 can be slid back and forth relative to the holder member 62 while guided along the rear plate guide member 78.

In the state where the side portion 64*a* is inserted in the room in the housing portion 74, the first and second pinion gears 85, 86 are provided between the racks 68 and 82 that are opposed to each other. The first pinion gear 85 is rotatably supported at its shaft by a recess 87 formed in the front plate 63, at a position where the first pinion gear engages the rack 68. Similarly, the second pinion gear 86 is rotatably supported at it shaft by a recess 88 formed in the front plate 63, at a position where the second pinion gear 86 engages the rack 82 and the first pinion gear 85. A reduction ratio of the first pinion gear 85 to the second pinion gear 86 is set to 2:1.

Because the first and second pinion gears 85, 86 are rotatably supported by the front plate 63, as described above, a predetermined gap is produced between the first and second gears 85, 86 and the bottom wall of the housing portion 74. In this gap, the bottom wall 83 of the side portion 64*b* can move back and forth.

As the rear plate 64 is slid back and forth relative to the holder member 62, the holder member 62 is slid back and forth relative to the front plate 63 via the rack 68, the first pinion gear 85, the second pinion gear 86 and the rack 82. In particular, the reduction ratio of the first pinion gear 85 to the second pinion gear 86 is set to 2:1. Accordingly, when the rear plate 64 is slid forward relative to the holder member 62, the holder member 62 is slid forward by a half distance traveled forward by the rear plate 64.

The holder arm 75 has arm support portions 91 that protrude outward in the width direction from each front edge of the housing portion 74 and swing arms 92 that are supported by the arm support portions 91. One end of each swing arm 92 is swingably supported by the arm support portion 91. Leg portions 94*a*, 94*b* extending outward in the width direction are formed at another ends. The front plate 63 and the rear plate 64 supported by the holder member 62 can be swung relative to the swing arms 92 on each arm support portion 91.

An engagement protrusion 96 protruding outward in the width direction is formed at the leg portion 94*b*. Guide members 93*a* and 93*b* that extend in parallel to the back and forth direction of the sheet cassette 52 are provided at positions each opposed to the leg portion 94*a* and 94*b*. The guide members 93*a*, 93*b* are omitted in FIG. 1, and the guide member 93*b* is shown by a phantom line in FIG. 6. The guide member 93*b* is formed in a C-shape in cross section and has a guide groove 95. The protrusion 96 of the leg portion 94*b* is engaged with the guide groove 95. Further, the leg portion 94*a* contacts the guide member 93*a*. When the holder frame 73 is slid back and forth relative to the front plate 63 under this condition, the holder arm 75 is guided back and forth along the guide members 93*a*, 93*b*.

Spring rests 97 that have a generally round shape and protrude in expanded condition are formed at positions opposed to each spring pressing portion 76 of the swing arms 92. The springs 89 urging the sheet pressing plate 53

(the front and rear plates 63, 64)upward are provided between each spring rest 97 and spring pressing portion 76. The urging force from those springs 89 acts in a direction that the holder frame 73 and the swing arm 92 are apart from each other. The swing arms 92 are swung on the arm support portion 91, so that the sheet pressing plate 53 is moved upward.

Figure 7:
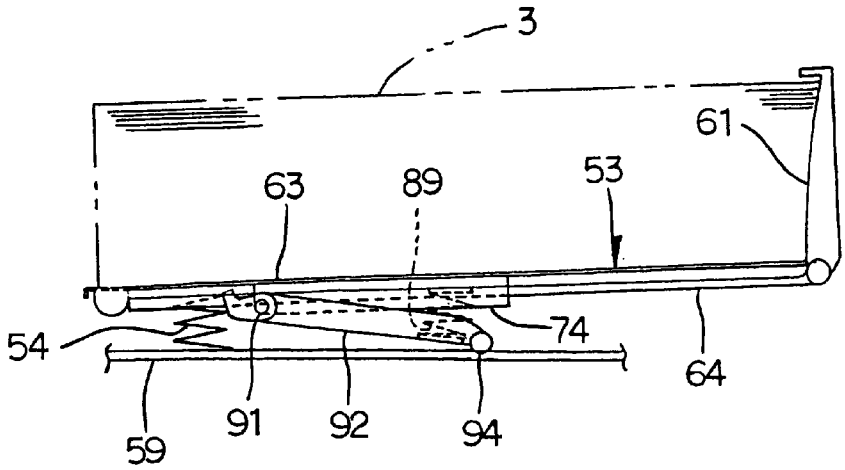
FIG. 7 is a side view of a state where an maximum amount of small sized sheets are staked in the sheet cassette of FIG. 2.
Figure 8:
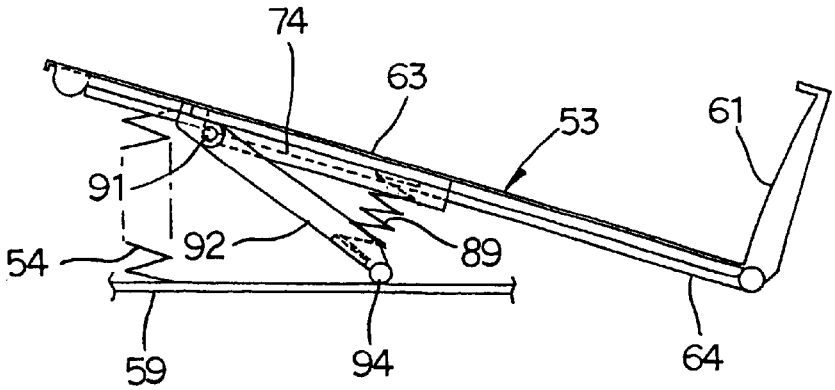
FIG. 8 is a side view of a state where no sheets are stacked in the sheet cassette of FIG. 7.

When small sized sheets 3, e.g., A4- or B5-size sheets, are accommodated in the sheet cassette 52 structured as described above, as shown in FIG. 7, the sheets 3 are stacked on the sheet pressing plate 53 and the end guide 61 is slid forward to make contact with the rear edges of the sheets so as to support the rear portion of the sheets 3.

Then, the rear plate 64 moves forward together with the end guide 61. In synchronization with this movement, the holder member 62 moves forward relative to the front plate 63 by the half distance traveled forward by the rear plate 64, via the rack 68, the first pinion gear 85, the second pinion gear 86, and the rack 82. That is, when the end guide 61 is moved according to the size of the sheets 3, the holder member 62 is moved relative to the sheet pressing plate 53 and supports the sheet pressing plate 53 near the center of gravity of the sheets 3.

Figure 5:
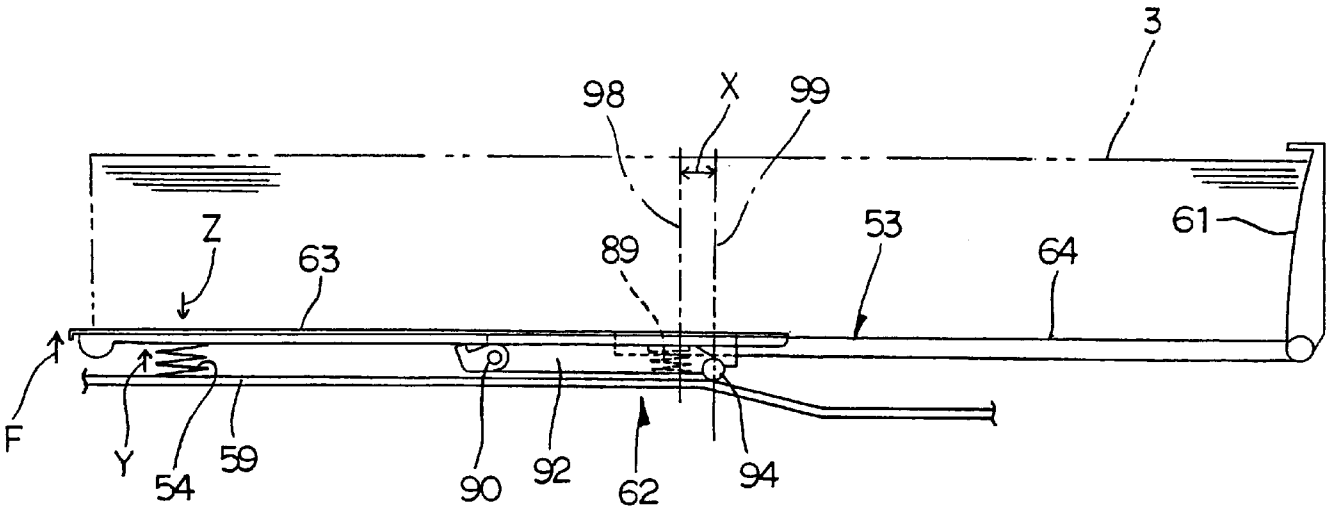
FIG. 5 is a side view of a state where a maximum number of large sized sheets are stacked in the sheet cassette of FIG. 2.

On the other hand, when large sized sheets 3, e.g., A3- or B4-size sheets, are accommodated in the sheet cassette 52, as shown in FIG. 5, the end guide 61 is slid backward, the sheets 3 are stacked on the sheet pressing plate 53 and then the end guide 61 is made to contact with the rear edges of the sheets 3 so as to support the rear portion of the sheets 3.

Then, the rear plate 64 moves backward together with the end guide 61. In synchronization with this movement, the holder member 62 moves backward relative to the front plate 63 by the half distance traveled backward by the rear plate 64, via the rack 68, the first pinion gear 85, the second pinion gear 86 and the rack 82. That is, when the end guide 61 is moved according to the size of the sheets 3, the holder member 62 is moved relative to the sheet pressing plate 53 and supports the sheet pressing plate 53 near the center of gravity of the sheets 3.

Even when the size of the sheets 3 to be accommodated in the sheet cassette 52 is changed, the holder member 62 supports the sheet pressing plate 53 near the center of gravity of the sheets 3 at all times. Therefore, the sheet pressing plate 53 can be swung with stability at all times.

The holder member 62 moves back and forth relative to the sheet pressing plate 53 in synchronization with the movement of the end guide 61. With such an extremely simple operation, the holder member 62 can support the sheet pressing plate 53 near the center of gravity of the sheets 3 at all times.

The reduction ratio of the first pinion gear 85 to the second pinion gear 86 is set to 2:1. Therefore, the holder member 62 moves back and forth relative to the sheet pressing plate 53 by the half distance traveled back and forth by the end guide 61, so that the holder member 62 surely supports at the center of gravity of the sheets 3.

In the laser beam printer 1 provided with the sheet cassette 52 structured as described above, sheet feeding can be stably and surely performed at all times even when the size of the sheets 3 to be accommodated in the sheet cassette 52 is changed.

In the sheet cassette 52, the sheet pressing plate 53 can be moved vertically by swinging the swing arms 92 and is urged upward by the springs 89. Therefore, when the weight of the stack of sheets 3 is heavy because a large number of sheets 3 are stacked, the weight of the stack of sheets overcomes the urging force from the springs 89 and thus the sheet pressing plate 53 is moved downward. In accordance with the downward movement of the sheet pressing plate 53, the rear end of the sheet pressing plate 53 is also moved downward. This state is shown in FIG. 5 that shows a state where the maximum number of sheets 3 are stacked.

Figure 6:
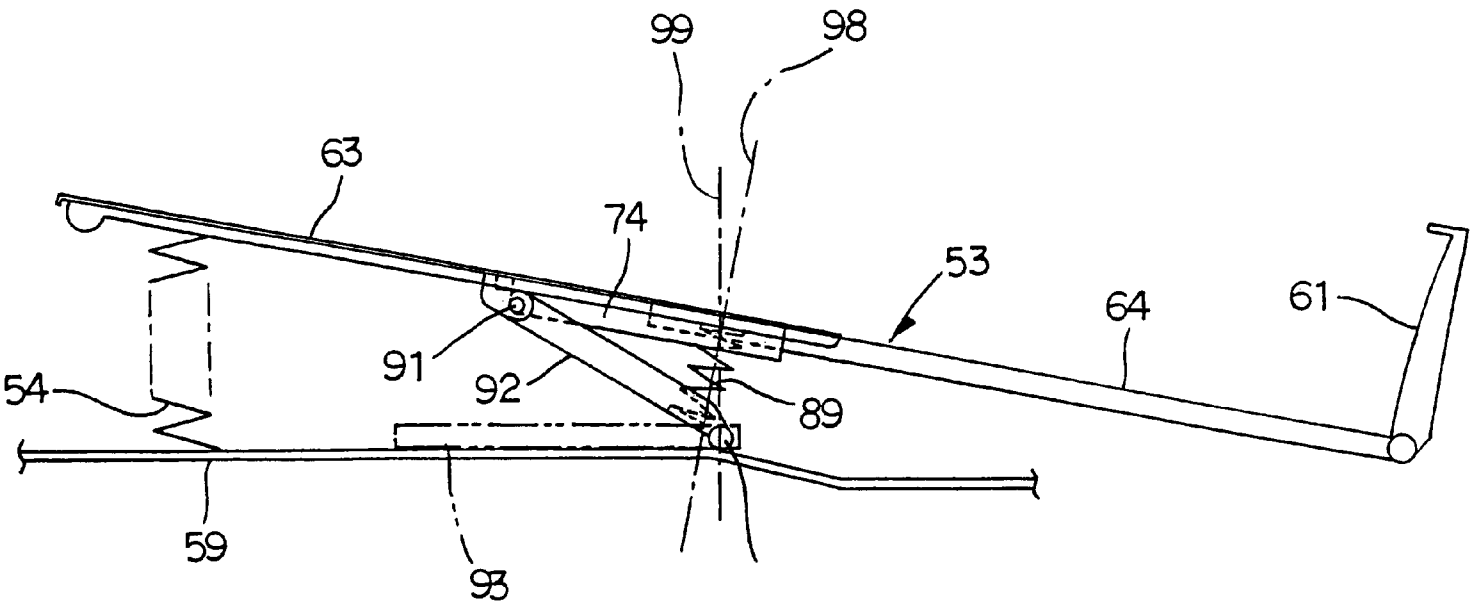
FIG. 6 is a side view of a state where no sheets are stacked in the sheet cassette of FIG. 5.

On the other hand, when the weight of the stack of sheets 3 is light because few sheets 3 are stacked, the urging force from the springs 89 overcomes the weight of the stack of sheets 3 and thus the sheet pressing plate 53 is moved upward. At that time, the pressing plate 53 is moved upward. However, the urging force from the springs 54 is stronger than the urging force from the springs 89, so that the front end of the front plate 63 is lifted upward and the rear end of the rear plate 64 is not so much moved upward as much as the front end. This state is shown in FIG. 6 that shows a state where no sheets 3 are stacked.

That is, there is little variation in the position of the rear end of the sheet pressing plate 53 between a case when a large number of sheets 3 are stacked and a case when few sheets 3 are stacked. Accordingly, a vertical stroke of the rear end of the sheet pressing plate 53 can be small, so that the sheet cassette 52 and the laser beam printer 1 can be made compact in size.

In the case where a spring constant of the spring 89 is the same value as the weight per unit thickness of the stack of sheets 3, the spring 89 acts to move the sheet pressing plate 53 downward by the amount corresponding to a thickness of the sheets 3 added. Therefore, an uppermost sheet 3 in the stack on the sheet pressing plate 53 can be held at a certain position at all times. Consequently, there is little variation in the vertical movement and stable sheet feeding can be achieved.

Further, as described above, the springs 89 are structured to urge the sheet pressing plate 53 at all times near the center of gravity of the stack of sheets 3, so that the urging force from the springs 89 can most accurately act on the sheet pressing plate 53 and the sheet pressing plate 53 can be moved with stability.

In particular, as shown in FIG. 5, the holder member 62 is disposed to support the sheet pressing plate 53 at a position which is apart from the center of gravity 98 of the stack of sheets 3 on the sheet pressing plate 53 in the back and forth direction and at a position 99 where a pressing force acting on the front end of the sheet pressing plate 53 by the urging force from the spring 54 becomes nearly constant regardless of the weight of the stack of sheets 3 on the sheet pressing plate 53.

That is, the holder member 62 supports the sheet pressing plate 53 at the position 99 expressed by X that satisfies an equation (1) below.

$$Y-2XZ=F \text{ (F=nearly constant)} \quad (1)$$

wherein:

Y is the urging force from the spring 54;

X is the offset from the center of gravity in the back and forth direction of the sheet 3;

Z is the weight per unit length of the stack of sheets 3; and

F is the pressing force acting on the front end of the sheet pressing plate 53.

When the sheet pressing plate 53 is supported at such a position 99, for example, the weight per unit length Z of the stack of sheets 3 changes as the number of sheets 3 changes. Even when the urging force Y from the spring 54 changes in accordance with this change, the pressing force F acting on the front end of the sheet pressing plate 53 is nearly constant at all times.

A concrete example will be described below. It is assumed that an entire length of the sheet pressing plate 53 is 354 mm, a maximum stack weight of the sheets 3 is 3400 g, and the spring that produces the urging force of 400 gf in the most compressed state and the urging force of 200 gf in the most stretched state is used as the spring 54. When the holder member 62 is disposed so as to support the sheet pressing plate 53 at the position 99 offset 10 mm backward from the center of gravity 98 of the stack of sheets 3, the pressing force F acting on the front end of the sheet pressing plate 53 when the maximum amount of sheets 3 are stacked (a state shown in FIG. 5) is 400 gf−2 ×10 mm×(3400 gf/354 mm)=209 gf that is derived from the equation (1) above.

After that, in accordance with a decrease in the number of the sheets 3 by feeding, each swing arm 92 is swung on the arm support portion 91 and thus the sheet pressing plate 53 is moved upward by the urging force from the springs 89. Therefore, the offset position 99 gradually approaches the center of gravity 98 of the sheets 3 as the sheets 3 are decreased in quantity. When the sheets 3 are all fed and no sheet 3 remains on the sheet pressing plate 53 (a state shown in FIG. 6), the holder member 62 supports the sheet pressing plate 53 at the center of gravity 98 of the sheet 3, so that the offset becomes zero. At the time, the pressing force F acting on the front end of the sheet pressing plate 53 is 200 gf−0=200 gf that is derived from the equation (1) above. A difference between two values that are the pressing force F in a case when the maximum amount of sheets 3 are stacked and the pressing force F in a case when no sheets are stacked is within 5%. It may be accepted that this value is nearly constant.

In this example, it is assumed that the offset X is 10 mm. However, the offset X is changed in accordance with size or density of the sheets 3 or the urging force from the spring 54, as necessary.

As described above, if the holder member 62 supports the sheet pressing plate 53 at the position that is offset a predetermined amount from the center of gravity 98 of the sheet 3, the pressing force F acting on the front end of the sheet pressing plate 53 becomes nearly constant even when the urging force Y from the springs 54 is changed in accordance with the amount of stacked sheets 3. Consequently, stable sheet feeding can be achieved.

Further, the pressing force F acting on the front end of the sheet pressing plate 53 is preferably constant within ±10%. By making the urging force from the springs 54 act on the sheet pressing plate 53 with the constant pressing force within ±10%, the sheets 3 can be fed with stability.

The constant pressing force acting on the front end of the sheet pressing plate 53 is, in particular, 100–600 gf, and preferably 200–400 gf. That is, when the spring 54 is structured so that its urging force acts on the sheet pressing plate 53 with the constant pressing force of within 100–600 gf, the sheet pressing plate 53 can press the sheet 3 against the sheet feed roller 7 by a suitable pressing force at all times. Accordingly, the sheets 3 can be fed with stability.

In this embodiment, the offset X is changed in accordance with the weight per unit length Z of the stack of sheets 3 in the equation (1) described above. However, it should be appreciated that, the urging force Y may be provided from a plurality of springs 54. Further, the urging force F from the spring 54 and the offset X may be fixed in accordance with the weight range of the stack of sheets 3.

As described above, the rear plate 64 doubles as the holder of the end guide 61, and the rear plate 64 and the end guide 61 move together back and forth. However, the sheet pressing plate 53 may be formed by integrating the front plate 63 with the rear plate 64, and the end guide 61 may be disposed on the sheet pressing plate 53 so as to be slidable back and forth. In this case, the holder member 62 may be structured to slide back and forth relative to the sheet pressing plate 53 in synchronization with the slide movement of the end guide 61.

The spring constant of the spring 89 is set to the same value as the weight per unit thickness of the stack of sheets 3. However, it is to be understood that the invention is not restricted to the particular forms described above. According to purposes and uses, a spring that has any appropriate spring constant may be used.

Figure 9:
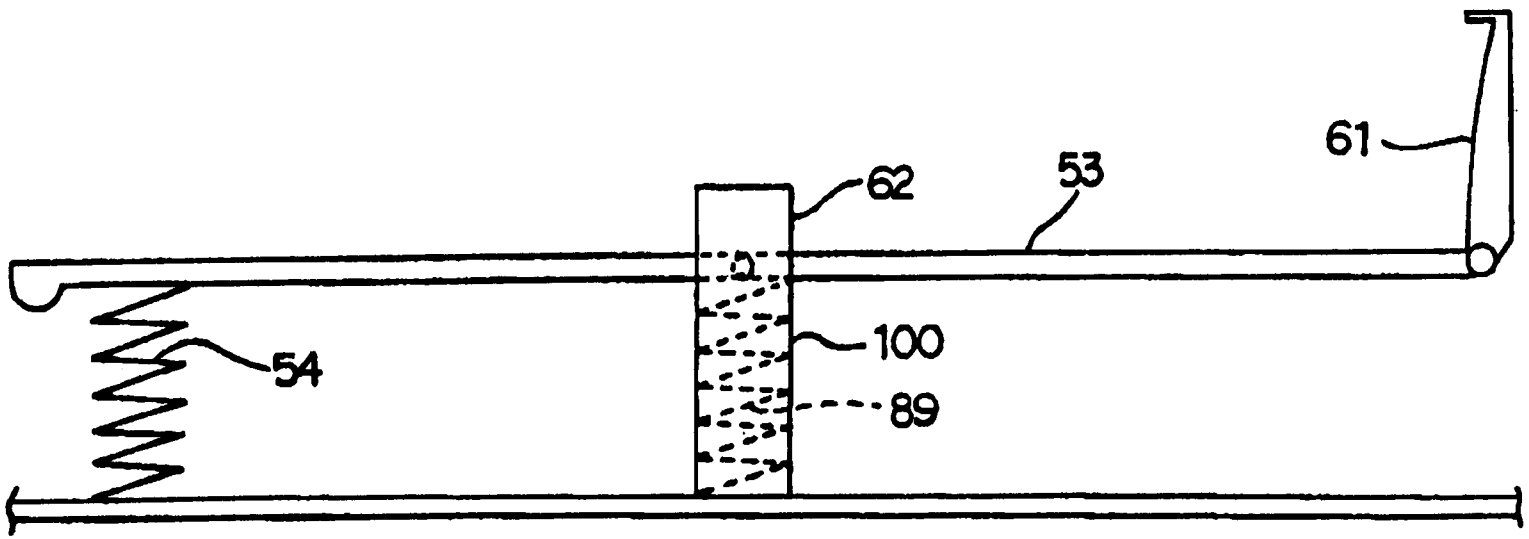
FIG. 9 is a side view of a modification of the sheet cassette.
Figure 10:
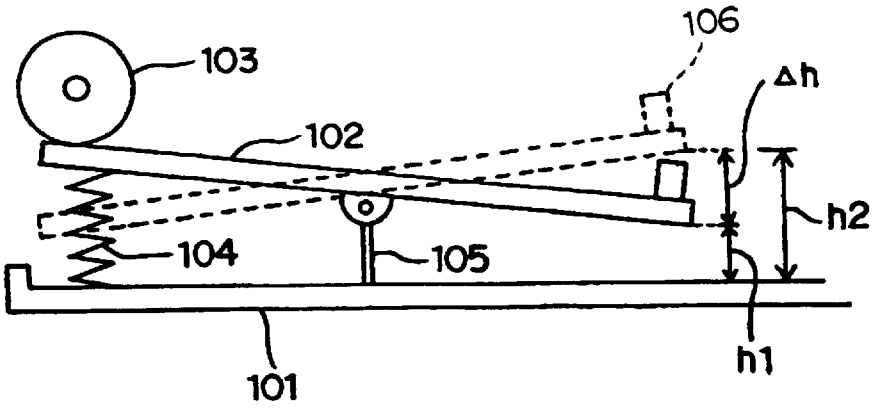
Fig. 10 RELATED ART
FIG. 10 is a side view of a conventional seesaw type sheet cassette.

Further, as shown in FIG. 9, the sheet cassette may be structured such that the holder member 62 supports the sheet pressing plate 53, a guide rail 100 for guiding the springs 89 along the up and down direction is provided to the holder member 62, and the spring is inserted in the guide rail 100, so that the sheet pressing plate 53 can be swung near its center of gravity and can be vertically moved.

Although the invention has been described as embodied in a laser beam printer, is should be appreciated that the invention is applicable to all image forming apparatus in which sheets of recording medium are fed to an image forming engine. It should also be appreciated that the invention is applicable to any apparatus that utilizes a feeder of stacked sheets.

While this invention has been described in conjunction with the exemplary embodiments outlined above, it is evident that many alternatives, modifications and variations will be apparent to those skilled in the art. Accordingly, the exemplary embodiments of the invention, as set forth above, are intended to be illustrative, not limiting. Various changes may be made without departing from the spirit and scope of the invention.

What is claimed is:

1. A sheet accommodating device, comprising:

a stacking portion holding at least sheet thereon;

a first urging member urging one end of the staking portion upward; and a support member movable back and forth relative to the stacking portion and supporting the stacking portion near a center of gravity of the at least one sheet on the stacking portion.

2. The sheet accommodating device according to claim 1, further comprising:

a rear edge support member supporting a rear edge of the sheet and movably disposed at a rear end of the stacking portion in accordance with sheet size; and a link mechanism moving the support member back and forth in accordance with a movement of the rear edge support member.

3. The sheet accommodating device according to claim 2, wherein the link mechanism acts so that the amount of travel of the support member becomes half of an amount of travel of the rear edge support member.

4. The sheet accommodating device according to claim 1, further comprising:

a second urging member urging the stacking portion upward near the support member.

5. The sheet accommodating device according to claim 4, wherein a spring constant of the second urging member is equal to a weight per unit thickness of the at least one sheet on the stacking portion.

6. The sheet accommodating device according to claim 1, wherein the support member supports the stacking portion so that a pressing force acting on one end of the stacking portion by the first urging member becomes constant regardless of the number of sheets stacked on the stacking portion.

7. The sheet accommodating device according to claim 6, wherein the support member supports the stacking portion at a position expressed by X that satisfies:

Y−2XZ=F, wherein is the urging force from the first urging member; X is the offset from the center of gravity in a back and forth direction of the at least one sheet; Z is the weight per unit length of the at least one sheet; and F is a nearly constant pressing force acting on one end of the stacking portion.

8. The sheet accommodating device according to claim 7, wherein a variation in the pressing force acting on the one end of the stacking portion according to a weight change of the at least one sheet on the stacking portion is ±10%.

9. The sheet accommodating device according to claim 8, wherein the pressing force acting on the one end of the stacking portion is between about 100–600 gf.

10. The sheet acommodating device according to claim 8, wherein the pressing force acting on the one end of the stacking portion is between about 200–400 gf.

11. An image forming apparatus including sheet accommodating device, the sheet accommodating device comprising:

a stacking portion holding at least sheet thereon;

a first urging member urging one end of the staking portion upward; and a support member movable back and forth relative to the stacking portion and supporting the stacking portion near a center of gravity of the at least one sheet on the stacking portion.

12. The image forming apparatus according to claim 11, further comprising:

a rear edge support member supporting a rear edge of the sheet and movably disposed at a rear end of the stacking portion in accordance with sheet size; and a link mechanism moving the support member back and forth in accordance with a movement of the rear edge support member.

13. The image forming apparatus according to claim 12, wherein the link mechanism acts so that the amount of travel of the support member becomes half of an amount of travel of the rear edge support member.

14. The image forming apparatus according to claim 11, further comprising:

a second urging member urging the stacking portion upward near the support member.

15. The image forming apparatus according to claim 14, wherein a spring constant of the second urging member is equal to a weight per unit thickness of the at least one sheet on the stacking portion.

16. The image forming apparatus according to claim 11, wherein the support member supports the stacking portion so that a pressing force acting on one end of the stacking portion by the first urging member becomes constant regardless of the number of sheets stacked on the stacking portion.

17. The image forming apparatus according to claim 16, wherein the support member supports the stacking portion at a position expressed by X that satisfies:

Y−2XZ=F, wherein Y is the urging force from the first urging member; X is the offset from the center of gravity in a back and forth direction of the at least one sheet; Z is the weight per unit length of the at least one sheet; and F is a nearly constant pressing force acting on one end of the stacking portion.

18. The image forming apparatus according to claim 17, wherein a variation in the pressing force acting on the one end of the stacking portion according to a weight change of the at least one sheet on the stacking portion is ±10%.

19. The image forming apparatus according to claim 18, wherein the pressing force acting on the one end of the stacking portion is between about 100–600 gf.

20. The image forming apparatus according to claim 18, wherein the pressing force acting on the one end of the stacking portion is between about 200–400 gf.

* * * * *